US005374057A

United States Patent [19]

Lai et al.

[11] Patent Number: 5,374,057

[45] Date of Patent: Dec. 20, 1994

[54] RACKETS HAVING DAMPING ELEMENTS

[75] Inventors: Ming-Lai Lai, Woodbury; Edmond J. Nielsen, Lake Elmo, both of Minn.

[73] Assignee: Minnesota Mining and Manufacturing Company, St. Paul, Minn.

[21] Appl. No.: 155,085

[22] Filed: Nov. 19, 1993

Related U.S. Application Data

[63] Continuation of Ser. No. 914,982, Jul. 16, 1992, abandoned.

[51] Int. Cl.[5] ..... A63B 49/02

[52] U.S. Cl. ..... 273/73 C; 273/73 F

[58] Field of Search ..... 273/73 R, 73 C, 73 F, 273/73 J

[56] References Cited

U.S. PATENT DOCUMENTS

| | | | |
|---|---|---|---|
| 4,368,886 | 1/1983 | Graf | 273/73 D |
| 4,609,194 | 9/1986 | Krent et al. | 273/73 D |
| 4,627,635 | 12/1986 | Koleda | 273/73 J X |
| 4,684,131 | 8/1987 | Mortvedt | 273/73 F |
| 4,875,679 | 10/1989 | Movilliat et al. | 273/73 C X |
| 4,876,169 | 10/1989 | Gruber et al. | 430/110 |
| 4,953,861 | 9/1990 | Nakanishi | 273/73 J |
| 4,983,242 | 1/1991 | Reed | 273/73 C X |
| 5,029,858 | 7/1991 | Chen | 273/73 F |
| 5,088,734 | 2/1992 | Glava | 273/73 J |
| 5,122,405 | 6/1992 | Landi | 273/73 F X |
| 5,262,232 | 11/1993 | Wilfong et al. | 428/327 |

FOREIGN PATENT DOCUMENTS

| | | | |
|---|---|---|---|
| 0304324 | 2/1989 | European Pat. Off. | 273/73 J |
| 0055184 | 6/1982 | France | 273/73 F |
| 2163963 | 3/1986 | United Kingdom | 273/73 J |

*Primary Examiner*—William E. Stoll

*Attorney, Agent, or Firm*—Gary L. Griswold; Walter N. Kirn; Robert W. Sprague

[57] ABSTRACT

A racket is provided with at least one damping element which is secured and positioned on the racket to substantially dampen the frame vibration of the racket when hit by a ball, shuttlecock or other object.

6 Claims, 21 Drawing Sheets

RACKETS HAVING DAMPING ELEMENTS

This is a continuation of application Ser. No. 07/914,982 filed Jul. 16, 1992, now abandoned.

FIELD OF INVENTION

This invention relates to rackets. In particular, the present invention relates to rackets having damping elements.

BACKGROUND OF THE INVENTION

When a ball is struck by a racket such as a tennis racket or racquetball racket, the racket bends and begins to vibrate. Since the vibration is produced when the player is gripping the racket, the vibration is translated to the player's arm. The degree of vibration imparted to the player's arm varies depending upon the racket material and construction.

Racket vibrations can be classified into several modes amongst which are three vibratory modes which normally affect the quality of play. A first mode, illustrated in FIG. 1, comprises a first bending mode of the racket frame and string. A second mode, depicted in FIG. 2, comprises a second bending mode of both the frame and strings. A third mode shown in FIG. 3 comprises the vibration of the strings in a plane perpendicular to the plane of the racket.

The vibrations would continue in absence of any damping property of the racket. Damping, for the purpose of this application, is defined as the dissipation of energy. Despite the natural intrinsic damping of the rackets, the vibrations are still discomforting to a player. Therefore, attempts have been made to increase the damping of the racket. For example, U.S. Pat. No. 4,609,194 to Krent et al. and U.S. Pat. No. 4,368,886 to Graf teach the use of inserts which dampen the vibration of strings. Although the inserts described in U.S. Pat. No. 4,609,194 and U.S. Pat. No. 4,368,886 have proven to be successful for damping string vibration, they have not proven satisfactory for damping the first and second modes of vibration hereinafter referred to as "frame vibration" which has proven to be more discomforting to a player. Frame vibration is more discomforting to a player than string vibration because the energy associated with such vibration is greater than string vibration and is directly translated to the player's arm.

U.S. Pat. No. 4,875,679 to Movilliat et al. describes one method of damping frame vibration. In this method, Movilliat et al. secures damping elements comprising viscoelastic material to very specific and relatively small portions of the racket. In particular, the damping elements are secured to the bridge of the racket or on both sides of the bridge. They can also be secured to the head or on both sides of the head. In addition, Movilliat teaches that damping elements can be centrally secured on both sides of the head. Although providing some damping affect, the Movilliat et al. racket provides less than optimal damping results.

U.S. Pat. No. 4,983,242 to Reed discloses yet another method of damping frame vibration. Reed teaches the use of a tennis racket frame comprising an inner tubular member and an outer tubular member. Sandwiched between the two tubular members is a dampening sleeve made of viscoelastic material. The sleeve is coextensive with both the tubular members. This racket is unsatisfactory because it is 20% weaker than a tubular racket because as Reed shows, the first modal frequency decreases from 55 to 50 Hz. In addition, Reed unnecessarily uses viscoelastic material thereby increasing the weight and cost of the racket.

Thus, there currently exists a need for a better solution than any disclosed above in order to substantially dampen the frame vibration of a racket.

SUMMARY OF THE INVENTION

The racket of the present invention comprises at least one damping element which substantially dampens the frame vibration of the racket. A "racket" is defined herein as any device consisting of a head with an interlaced network of strings and a handle depending from the head used to strike a ball, a shuttle cock or other objects.

In particular, the racket can comprise either a solid racket or a tubular frame which includes a head and a handle depending therefrom and at least one vibration damping element secured and positioned on said head to substantially dampen the frame and/or string vibration of a racket.

In a preferred embodiment of the present invention, the damping element comprises viscoelastic material secured to the frame by a constraining layer.

In addition, the present invention comprises a method of applying the damping element and/or elements to the racket.

DETAILED DESCRIPTION

Figure 1:
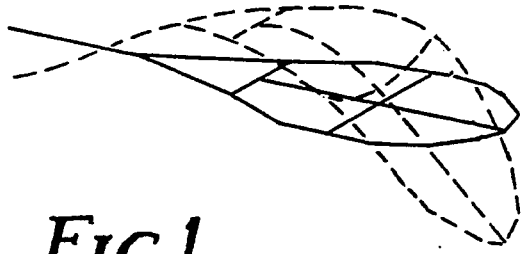
FIG. 1 illustrates a first vibratory mode of a racket.
Figure 2:
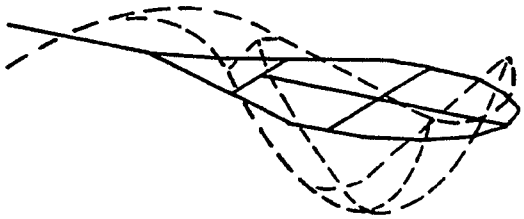
FIG. 2 illustrates a second vibratory mode of a racket.
Figure 3:
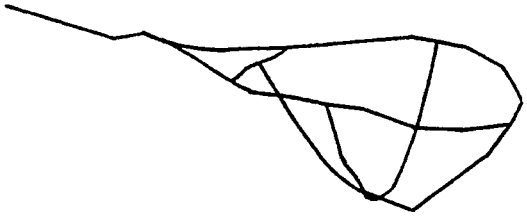
FIG. 3 illustrates a third vibratory mode of a racket.
Figure 4:
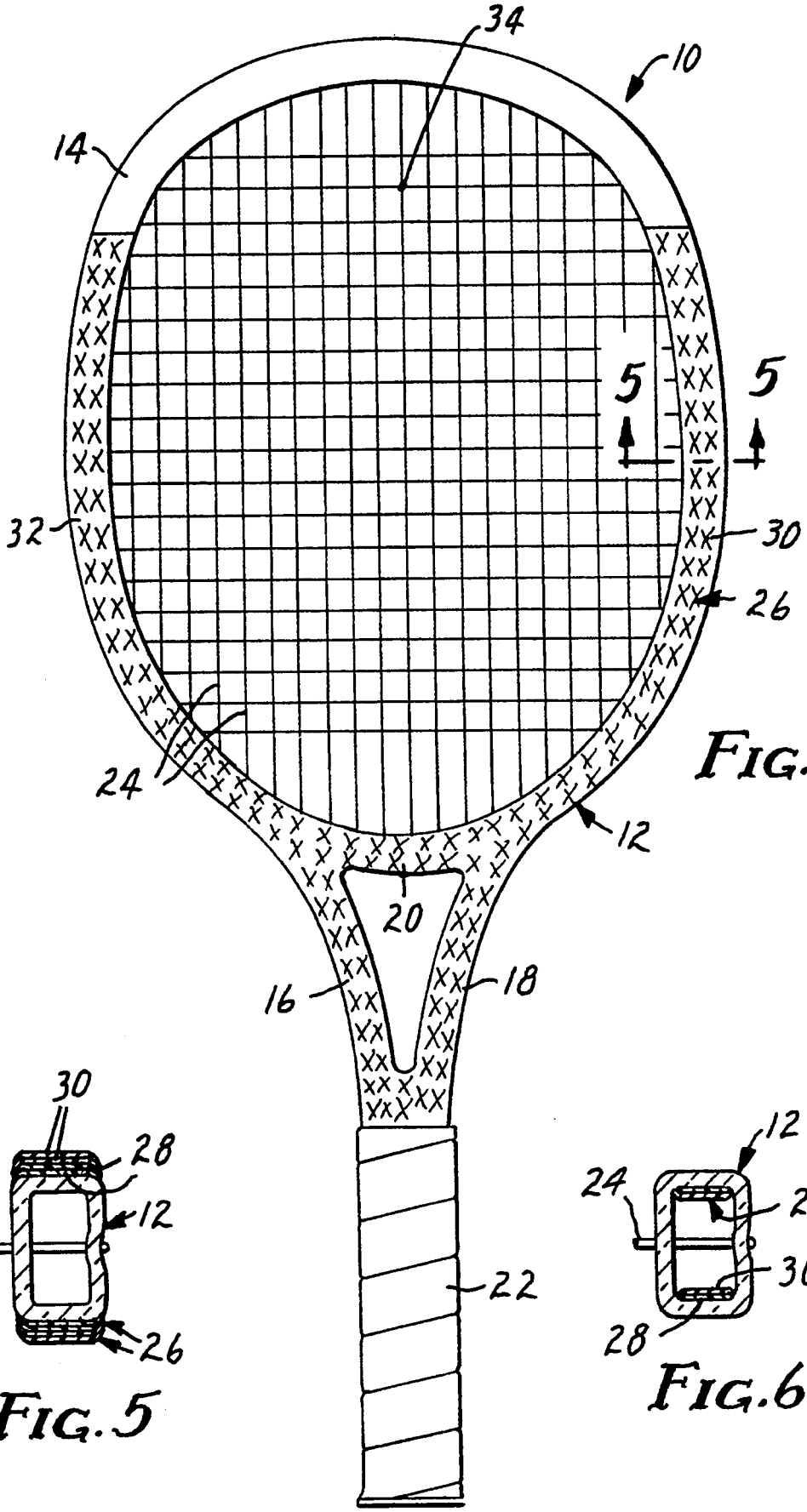
FIG. 4 is a plan view of a racket of the present invention.

Referring to FIG. 4, a racket 10 of the present invention comprises a frame 12 having a head portion 14, two branches 16, 18 which form a bridge 20 and a handle 22. Strings 24 are mounted in string holes (not illustrated) and are interlaced in any conventional manner to form a network of strings.

In order to dampen the frame and/or string vibration(s), damping elements 26 are secured to the frame 12. The damping elements 26 can comprise any material which effectively dampens frame and string vibrations and in particular, first mode vibrations. Preferably, the damping elements 26 comprise viscoelastic material 28. As used herein, the term viscoelastic refers to a material which exhibits a viscous and/or delayed elastic and/or inelastic response to stress in addition to instantaneous elasticity. The amount of energy dissipated depends upon the damping properties of the viscoelastic materials and therefore, the amount of damping can be tailored to the user's preference. Preferred viscoelastic materials include acrylic viscoelastic polymers sold under the tradenames ISD 110, ISD 112 and ISD 113 by the Minnesota, Mining and Manufacturing Company.

If desired, a constraining layer 30 can be used to secure the viscoelastic material 28 to the frame 12. The constraining layer 30 can be made of aluminum, graphite, steel, glass reinforced laminates, polyester films or any material which can constrain the viscoelastic material. The constraining layer 30 which is stiffer than the viscoelastic material constrains the viscoelastic material; therefore, the surface of the viscoelastic material attached to the racket is extended or compressed while the other surface attached to the constraining layer is held by the constraining layer thereby increasing the amount of shearing of the viscoelastic material 28. This results in a shear strain in viscoelastic material which significantly improves the dampening efficiency of the viscoelastic material. Examples of damping elements which have constraining layers are sold under the tradename SJ-2052X Type 0502, SJ-2052X Type 0805, SJ-2052X Type 1002 and SJ-2052X Type 1005 by Minnesota, Mining and Manufacturing Co.

The damping element 26 can be secured to the frame in a number of ways which one skilled in the art would recognize. A preferred way includes the step of securing the viscoelastic material 28 to the constraining layer 30 by attaching the viscoelastic material 28 to the constraining layer 30 and then heating the damping element 26 in a vacuum oven for 30 minutes at 150° C. After this procedure, the damping element 26 is secured to the racket 10.

Figure 5:
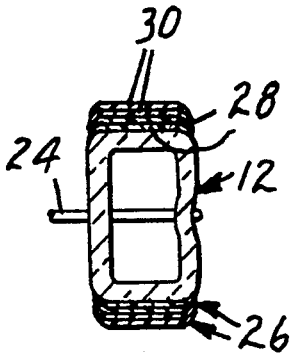
FIG. 5 is a cross-sectional view of the racket of FIG. 4 taken along line 5—5.
Figure 6:
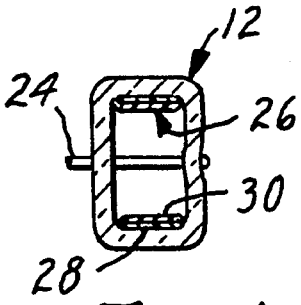
FIG. 6 is a cross-sectional view of another embodiment of the present invention taken along line 5—5.

The damping element 26 must be positioned on the frame 12 so that it substantially dampens the frame vibration of the racket 10. By substantial, it is meant that the damping ratio is at least 1.2%. The damping ration is of the critical damping. For example, the damping elements 26 can be secured to both sides of a first face 32 of the head 14 and extend from the top of head 14 to the bridge 16 or the damping elements 26 can extend from a portion of the head 14 just beneath the center of the head 14 to the bridge 16. Preferably, the damping elements 26, as indicated in FIG. 4, extend from a portion of racket 10 equidistant from the top of the head 14 and the center of the racket 10. If desired, the damping element 26 can also be secured to the second face of the head as illustrated in FIG. 5. Instead of being secured to an outer face of the head 14, the damping element 26, as shown in FIG. 6, can also be positioned on a surface inside the tubular frame corresponding to the first or second face of the head 14, respectively. In addition, the damping element 26 should be wide enough to sufficiently dissipate the energy caused by an impact. For example, widths of 3/16 inch (0.48 cm), ¼ inch (0.64 cm), and ⅜ inch (0.95 cm.) have been found to be suitable.

If desired, a layer 30 of damping elements 26 can be applied to the racket 10. In this case, the damping elements 26 are stacked one on top the other as illustrated in FIG. 5. The number of damping elements 26 in the layer depends upon the user's preference. In addition, the type of viscoelastic material 28 used can vary from one damping element 26 to another in layer 30 in order to tailor the damping to the user's preference. Optionally, layer 30 can be replaced by a damping element 26 of thickness equal to that of layer 30.

EXAMPLE 1

A test racket of the present invention utilizing damping elements was made by utilizing a Wilson Profile 2.7 si, 4¼-L4 racket strung with Babolat string at 26 kg. (58 pounds). The damping elements were made by attaching a 0.25 mm (10 mil.) element of viscoelastic material sold by the Minnesota Mining and Manufacturing Company under the tradename ISD, SJ2015 type 112 to a clean constraining layer comprising a dead soft aluminum foil which was 0.25 mm (10 mil.) thick. The damping element was then placed in a vacuum oven and heated at 150° C. for 30 minutes. After heating, the damping element was removed and cut into a 4.8 mm wide strip and secured to the first face of the racket as shown in FIG. 4. This procedure was repeated three times to install a total of three damping elements to both faces of the racket frame.

Figure 8B:
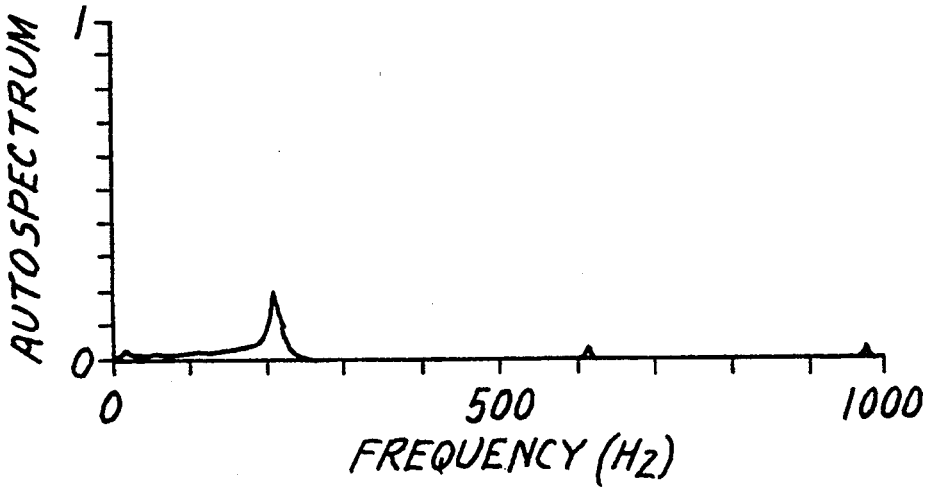
FIG. 8B is a graph of the vibration autospectrum of an impacted racket of one embodiment of the present invention.
Figure 8A:
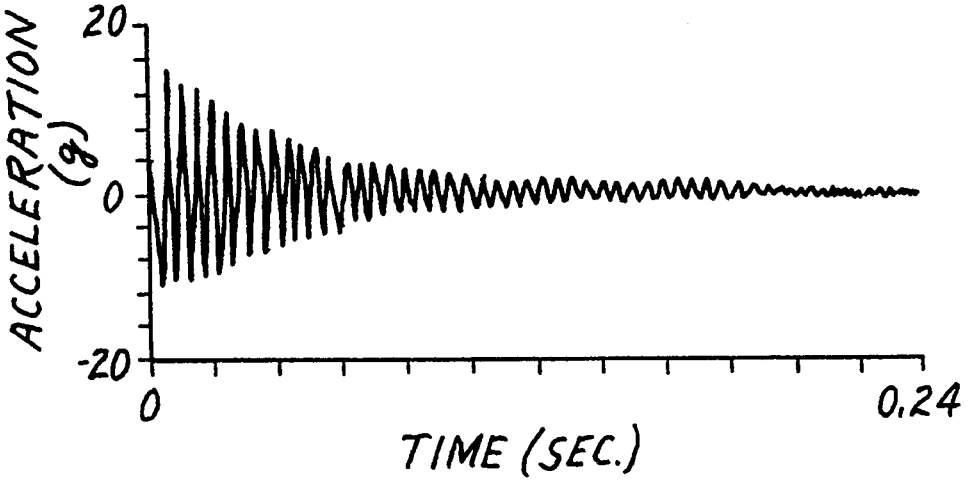
FIG. 8A is a graph of the vibration time trace of an impacted racket of one embodiment of the present invention.
Figure 9B:
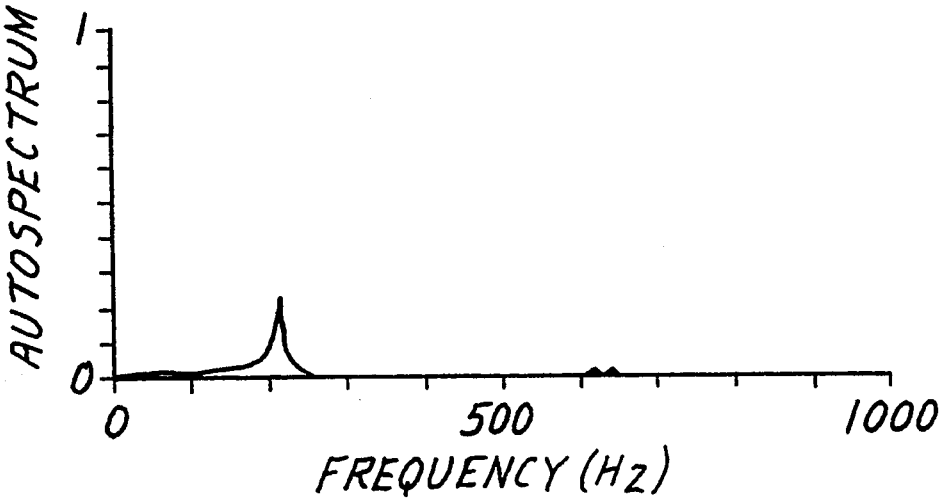
FIG. 9B is a graph of the vibration autospectrum of an impacted racket of a second embodiment of the present invention.
Figure 9A:
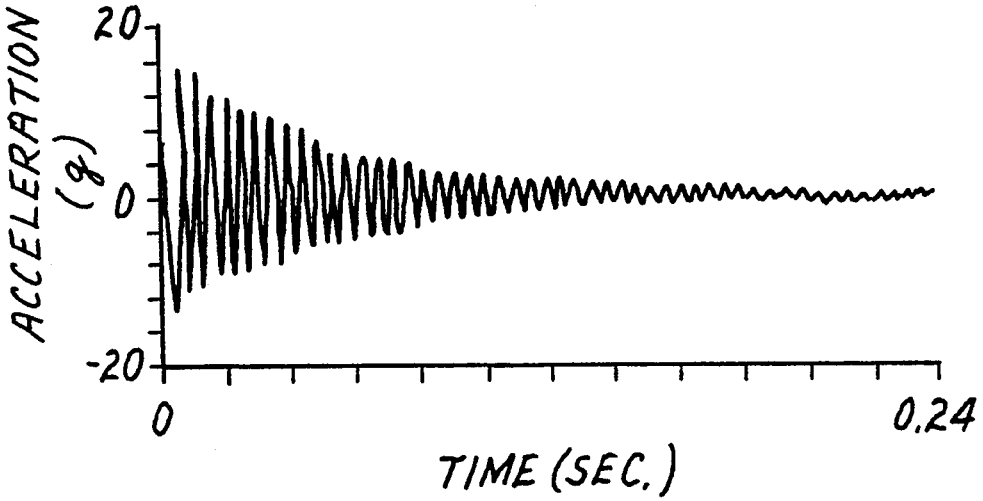
FIG. 9A is a graph of the vibration time trace of an impacted racket of a second embodiment of the present invention.
Figure 10B:
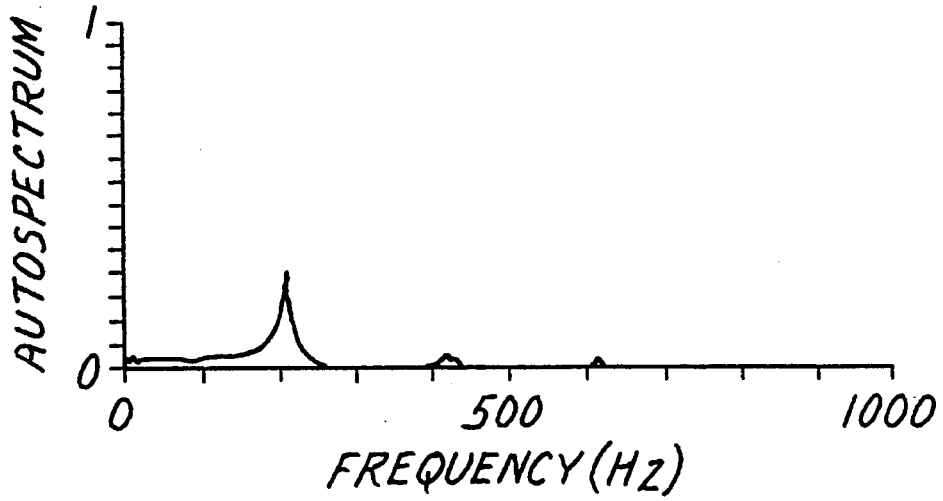
FIG. 10B is a graph of the vibration autospectrum of an impacted racket of a third embodiment of the present invention.
Figure 10A:
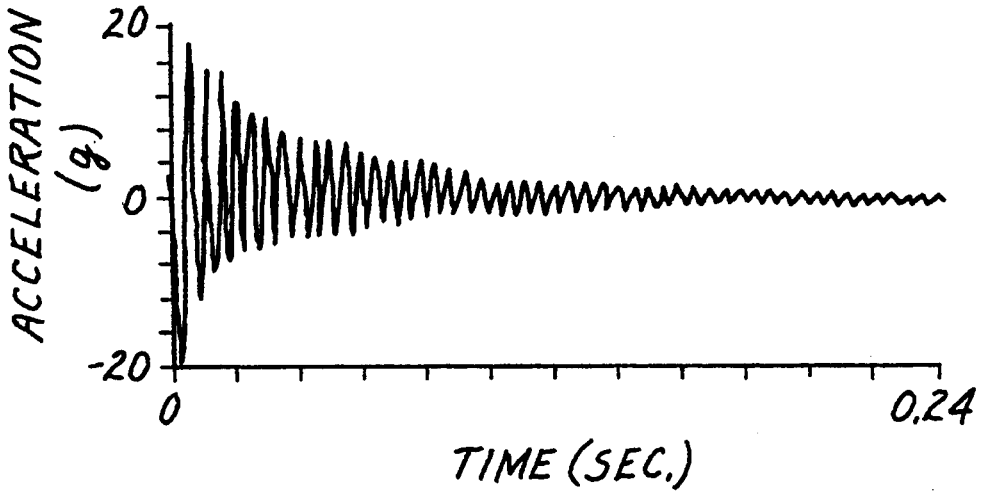
FIG. 10A is a graph of the vibration time trace of an impacted racket of a third embodiment of the present invention.
Figure 11B:
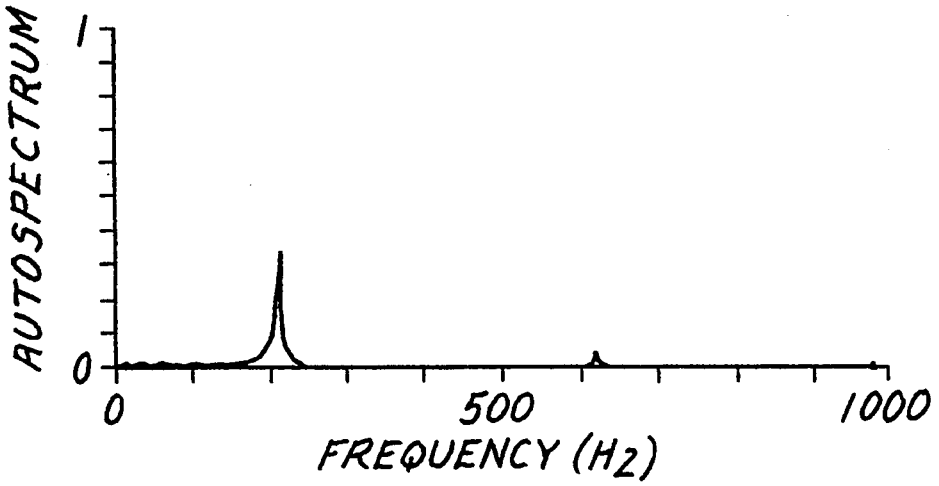
FIG. 11B is a graph of the vibration autospectrum of an impacted racket of a fourth embodiment of the present invention.
Figure 11A:
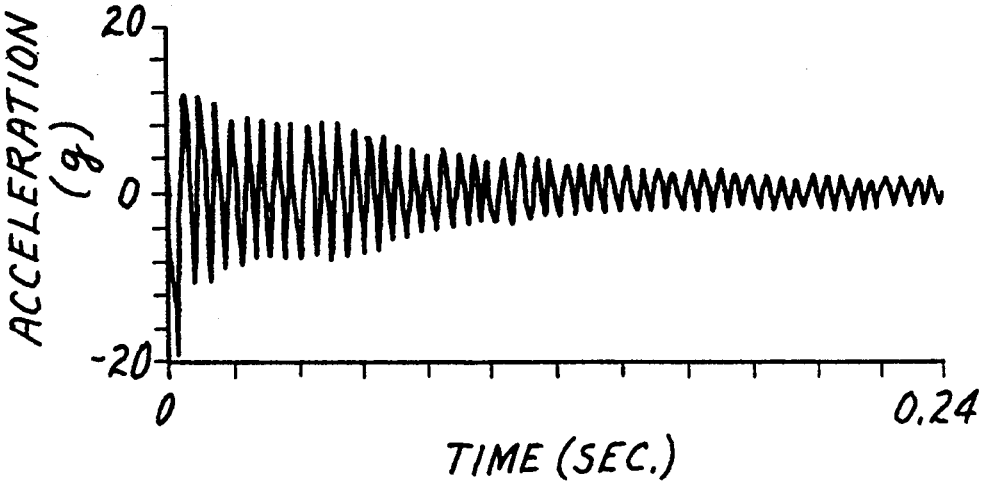
FIG. 11A is a graph of the vibration time trace of an impacted racket of a fourth embodiment of the present invention.

The racket was then stimulated by a PCB086B03 impact hammer sold by PCB Piezotronics, Inc. located at 3425 Walden Ave., Repen, N.Y. 14043 at 34 indicated in FIG. 4. The racket's response to the impact was measured by a PCB303A03 accelerometer as sold by PCB Piezotronics, Inc. processed with the signal conditioner sold under the tradename PCB483B17 commercially available from PCB Piezotronics, Inc. positioned at the handle 22 as shown in FIG. 4 and was reported as the vibrational time decay trace and the associated autospectrum shown in FIGS. 8A and 8B. The modal damping ratio is reported in Table 1.

COMPARATIVE EXAMPLE 1

Figure 7B:
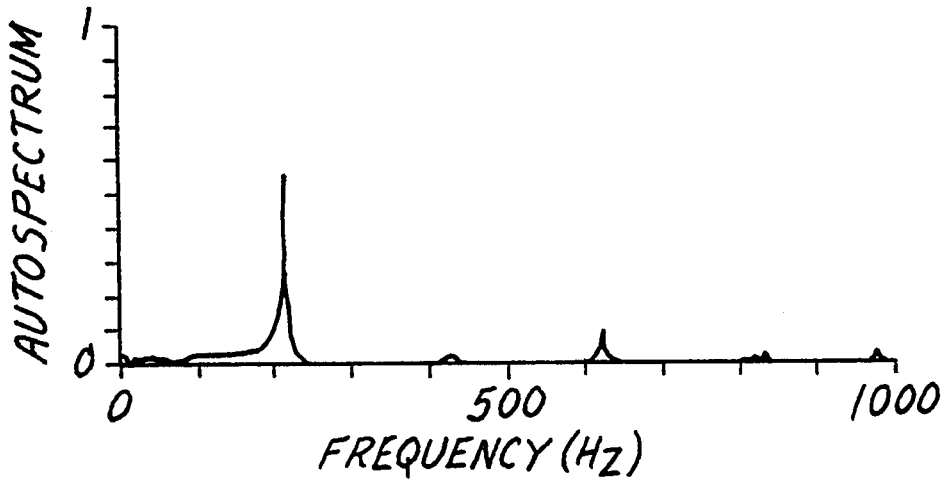
FIG. 7B is a graph of the vibration autospectrum of an impacted Wilson Profile racket.
Figure 7A:
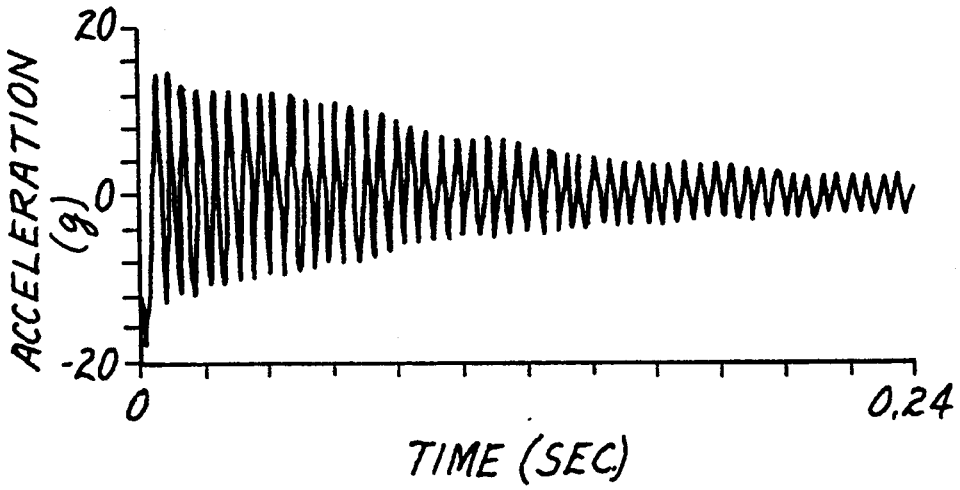
FIG. 7A is a graph of the vibration time trace of an impacted Wilson Profile racket.

The test racket of Comparative Example 1 comprised a Wilson Profile 2.7 si, 4¼-L4 racket strung with Babolat string at 26 kg. (58 pounds). No damping elements were utilized. The racket was tested in accordance with the procedures outlined in Example 1. The test results are reported in FIGS. 7A and 7B. The damping ratio is reported in Table 1.

EXAMPLES 2–4

Test rackets were constructed and tested in accordance with the method of Example 1. Examples 2–4 demonstrated damping element placement on one and two faces of the racket and the effect of differing the damping element lengths. The location and the lengths of the damping elements of Examples 2–4 are summarized in Table 1.

TABLE 1

| Ex. | Description of Treatment | Faces | Damping Ratio (%) |
|---|---|---|---|
| 1 | Long Damping Elements | Both | 1.60 |
| C1 | No Damping Elements | None | 0.40 |
| 2 | Long Damping Elements | One | 1.40 |
| 3 | Short Damping Elements | Both | 1.40 |
| 4 | Short Damping Elements | One | 0.77 |

The rackets of Examples 1–4 showed noticeable improvements in the damping ratio when compared to the racket of Comparative Example 1. The time decay of the acceleration of the rackets of Examples 1–4 as illustrated in FIGS. 8–11, respectively, was noticeably faster than the decay exhibited by the racket of Comparative Example 1. Similarly, the first modal frequency response of an impacted racket was visibly lower than the response of the racket of Comparative Example 1 indicating that more energy was dissipated in rackets of the present invention than the racket of Comparative Example 1.

EXAMPLES 5–7

The test rackets of Examples 5–7 comprised a mid-size racket sold under the trade name Wilson Hammer. Damping elements were attached to the racket. The damping elements were made by applying a 0.25 mm (10 mil) thick graphite constraining layer to a 0.25 mm (10 mil.) thick layer of viscoelastic material comprising sold by the Minnesota Mining and Manufacturing Company under the tradename ISD, SJ2015 type 112 which was 4.8 mm wide. The damping element comprising the graphite covered viscoelastic material was then secured to first face of the racket as shown in FIG. 4. This procedure was repeated three times to install a total of three damping elements to each side of the racket frame. Once wrapped with heat resistant tape, the test racket was placed in an oven for 15 minutes set at 150° C. (300° F.). After heating at 150° C. (300° F.), the test racket was cured at a temperature of 66° C. (150° F.) for two hours. Then the racket was strung with Wilson Thin Core string at 25 kg. (55 pounds).

The test rackets of Examples 5–7 varied in that they had damping elements of differing widths. The widths associated with the test rackets for each example are reported in Table 2. The rackets of Examples 5–7 were tested in accordance with the procedures outlined in Example 1 and the test results are reported in FIGS. 13–15, respectively. The modal damping ratio is reported in Table 2.

COMPARATIVE EXAMPLE 2

Figure 12B:
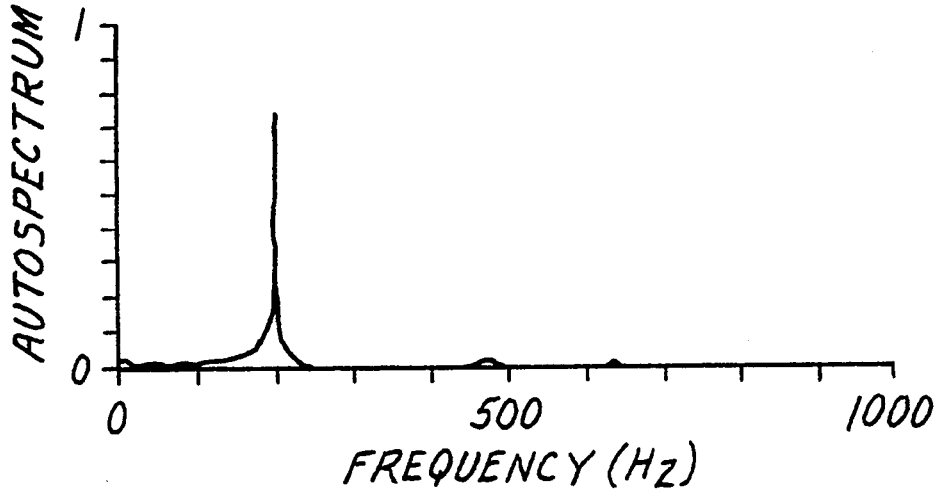
FIG. 12B is a graph of the vibration autospectrum of an impacted midsize Wilson Hammer racket.
Figure 12A:
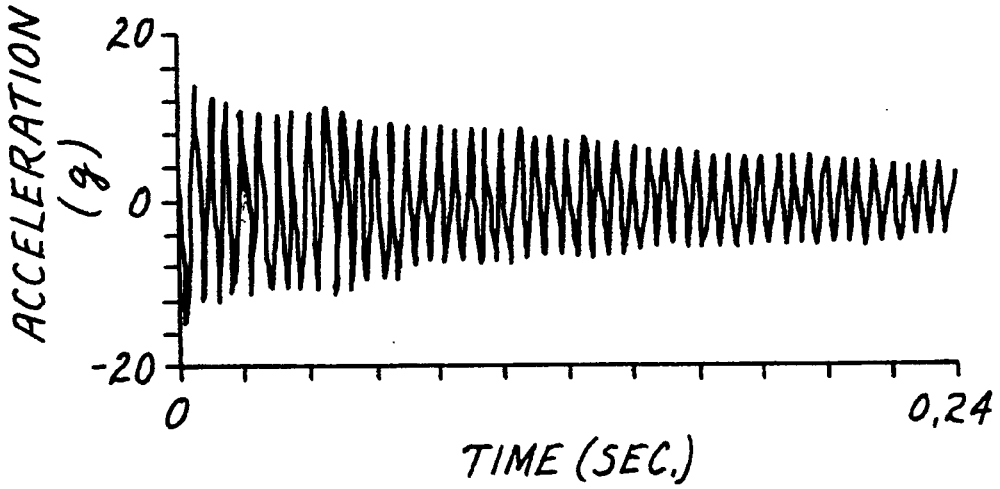
FIG. 12A is a graph of the vibration time trace of an impacted midsize Wilson Hammer racket.

The test racket of Comparative Example 2 comprised a mid-size racket sold under the tradename Wilson Hammer strung with Wilson Thin Core string at 25 kg. (55 pounds). This racket was tested in accordance with the procedures of Example 1. The test results are reported in FIGS. 12A and 12B. The damping ratio is reported in Table 2.

TABLE 2

| Ex. | Width of Constraining Layer | Damping Ratio (%) |
|---|---|---|
| 5 | 4.8 mm | 2.2 |
| 6 | 6.44 mm | 2.4 |
| 7 | 9.5 mm | 3.5 |
| C2 | No Damping Elements | 0.5 |

Figure 13B:
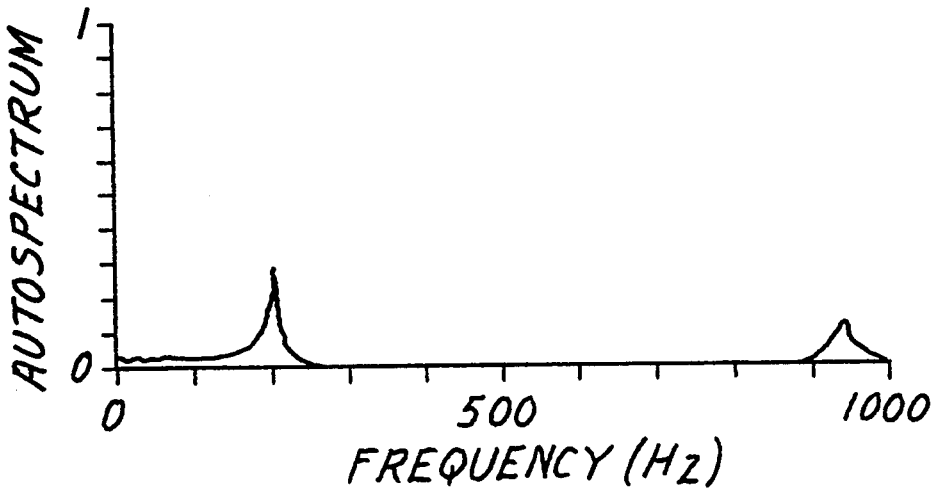
FIG. 13B is a graph of the vibration autospectrum of an impacted racket of the present invention having damping elements of 4.8 mm width.
Figure 13A:
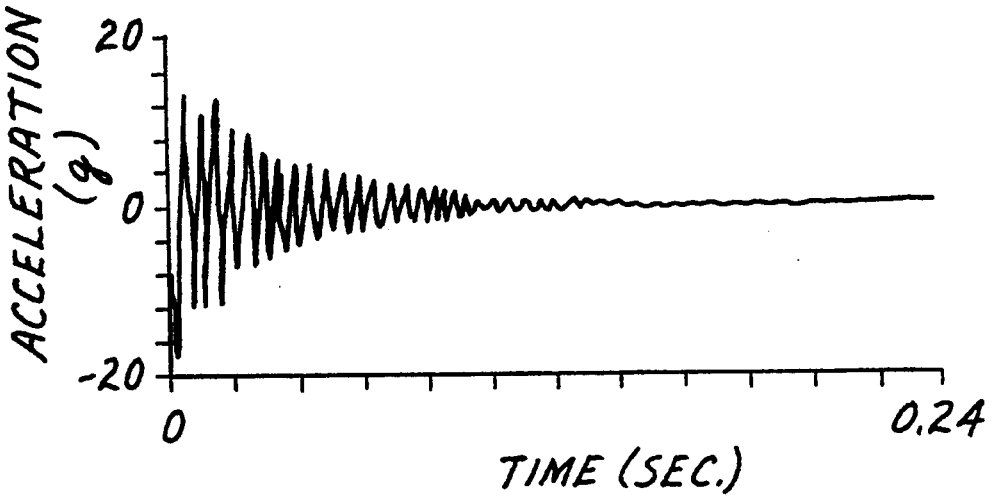
FIG. 13A is a graph of the vibration time trace of an impacted racket of another embodiment of the present invention having damping elements of 4.8 mm width.
Figure 14B:
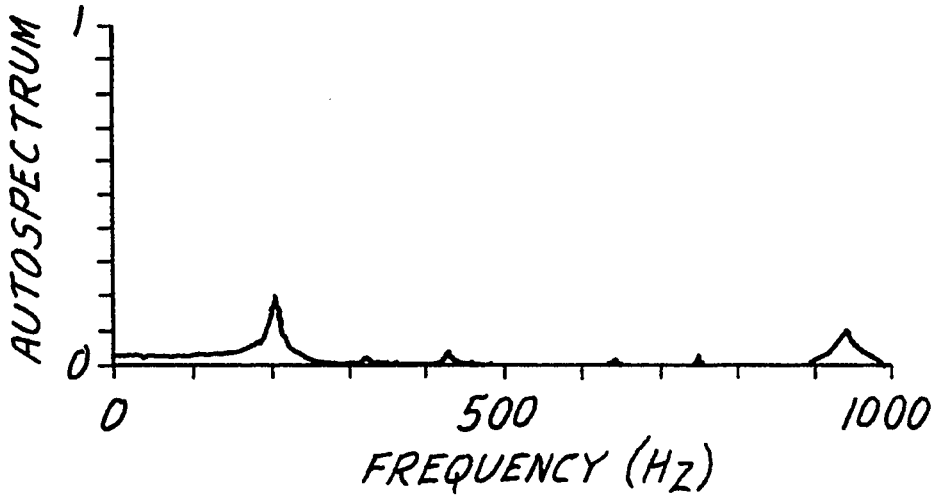
FIG. 14B is a graph of the vibration autospectrum of an impacted racket of the present invention having damping elements of 6.44 mm.
Figure 14A:
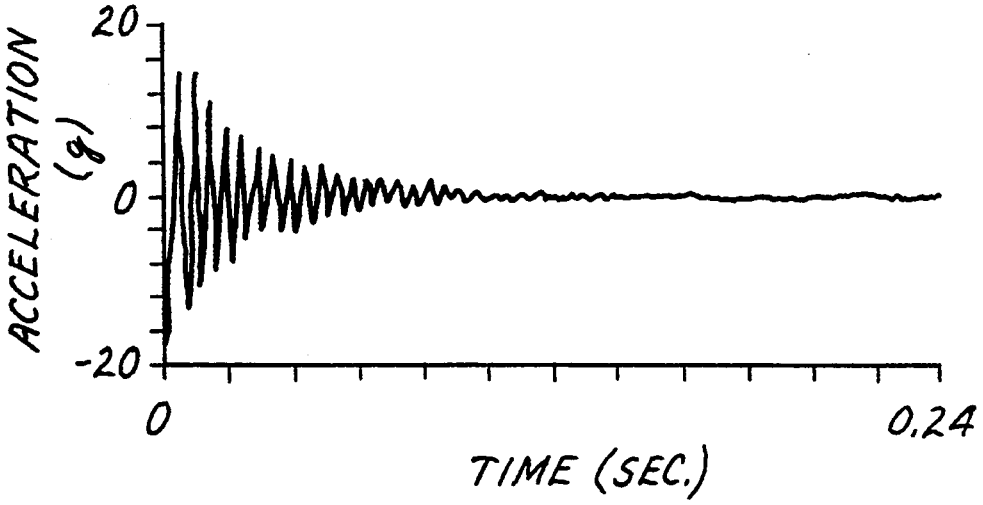
FIG. 14A is a graph of the vibration time trace of an impacted racket of the present invention having damping elements of 6.44 mm width.
Figure 15B:
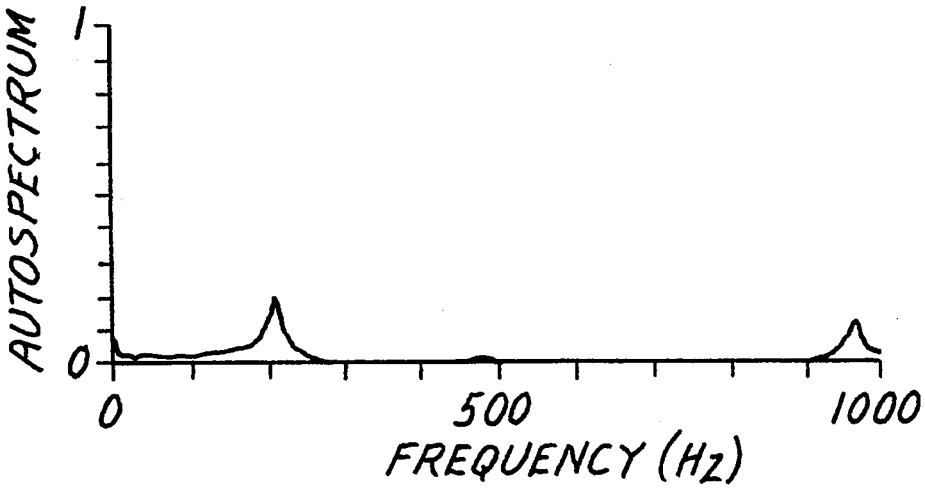
FIG. 15B is a graph of the vibration autospectrum of an impacted racket of the present invention having damping elements of 9.5 mm width.
Figure 15A:
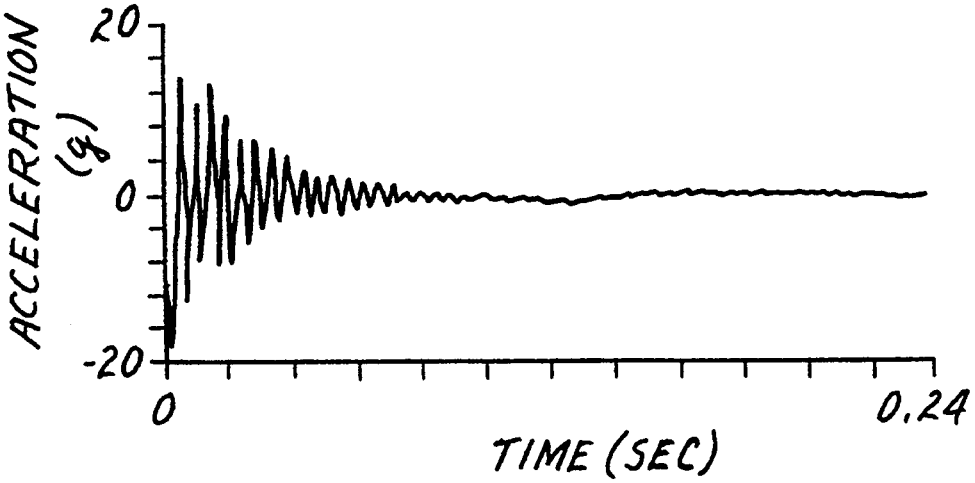
FIG. 15A is a graph of the vibration time trace of an impacted racket of the present invention having damping elements of 9.5 mm width.

The test results reported in Table 2 indicate a significant increase in the damping ratio of the rackets of Examples 5–7 when compared to the rackets of Comparative Example 2. In addition, it was observed that there was an increase in the damping ratio with width of the damping element. FIGS. 13–15 indicate that the time decay of the acceleration of the rackets of the present invention was noticeably faster than the decay exhibited by the racket of Comparative Example 2. Similarly, the first modal frequency response of an impacted racket when measured as a function of the time was visibly lower than the response of the racket of Comparative Example 2 indicating that more energy was dissipated in rackets of the present invention than those tested not within the scope of the present invention.

EXAMPLES 8–11

The test rackets of Examples 8–11 comprised an aluminum racket sold under the trade name Pro Kennex Power Prophecy 110. The test rackets were constructed and tested in accordance with the method of Example 1. Examples 8 and 9 demonstrated long damping element placement and the effect of differing the damping element lengths. Example 10 illustrated the placement of short damping elements. The test results for Examples 8–11 are reported in FIGS. 17–20, respectively. The location and the lengths of the damping elements of Examples 8–11 are summarized in Table 3.

COMPARATIVE EXAMPLE 3

Figure 16B:
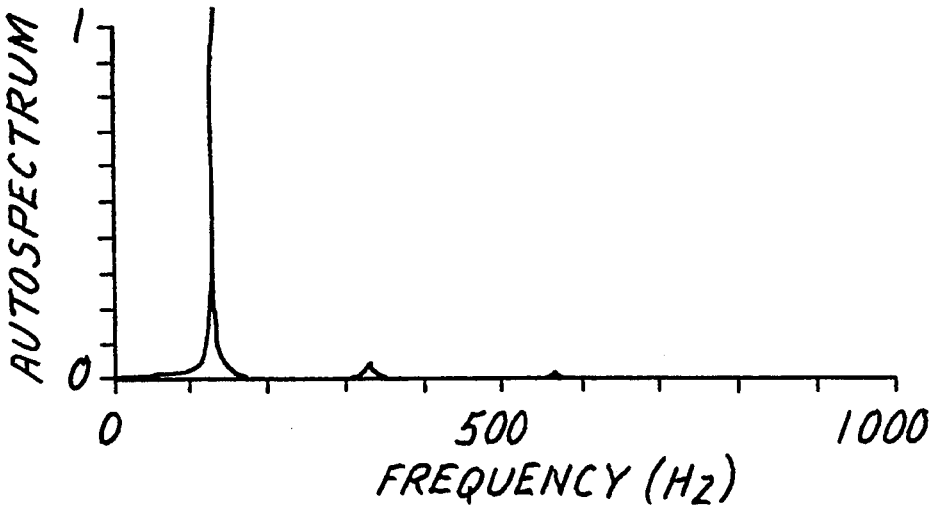
FIG. 16B is a graph of the vibration autospectrum of an impacted aluminum racket.
Figure 16A:
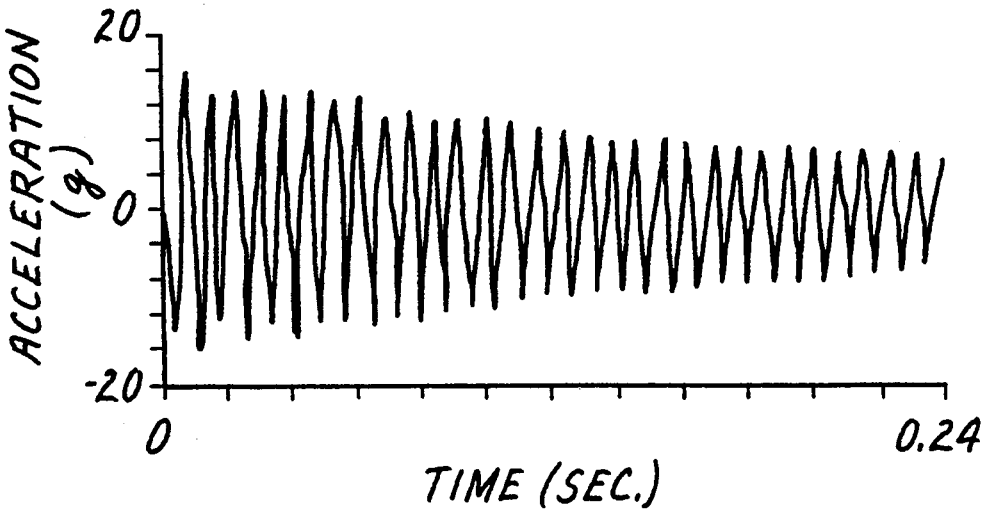
FIG. 16A is a graph of the vibration time trace of an impacted aluminum racket.
Figure 17B:
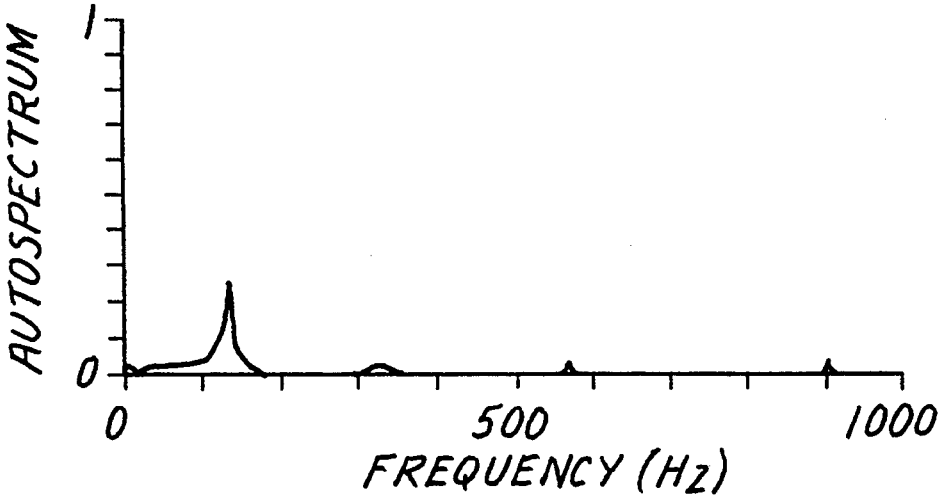
FIG. 17B is a graph of the vibration autospectrum of an aluminum impacted racket of one embodiment of the present invention.
Figure 17A:
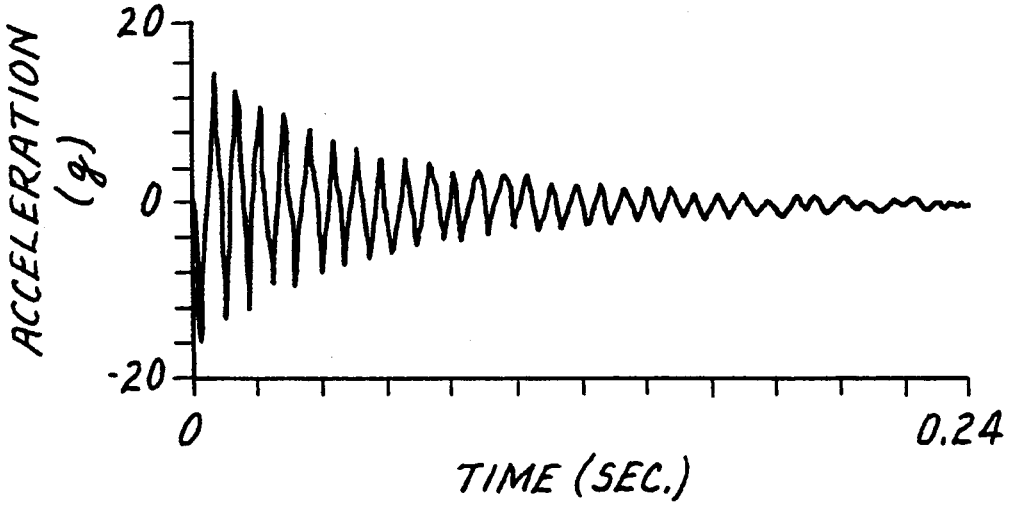
FIG. 17A is a graph of the vibration time trace of an impacted aluminum racket of one embodiment of the present invention.
Figure 18B:
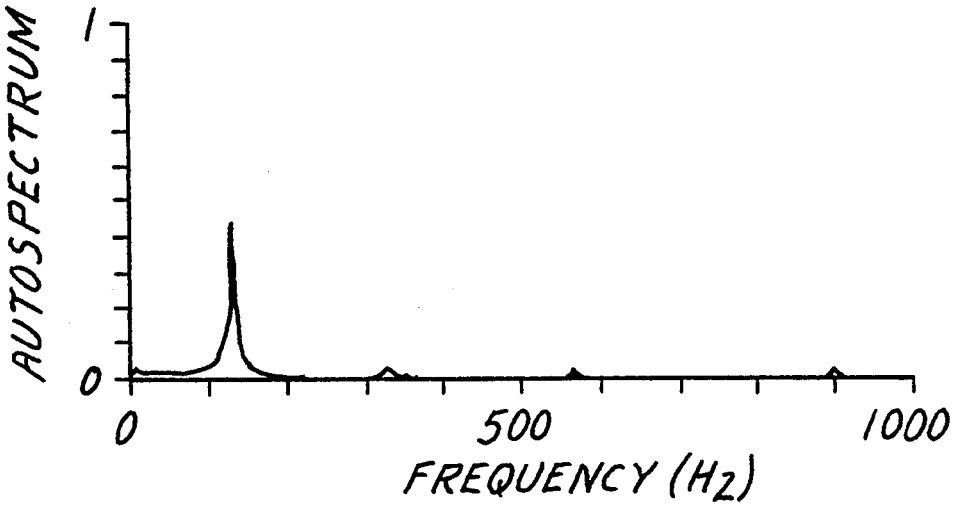
FIG. 18B is a graph of the vibration autospectrum of an impacted aluminum racket of a second embodiment of the present invention.
Figure 18A:
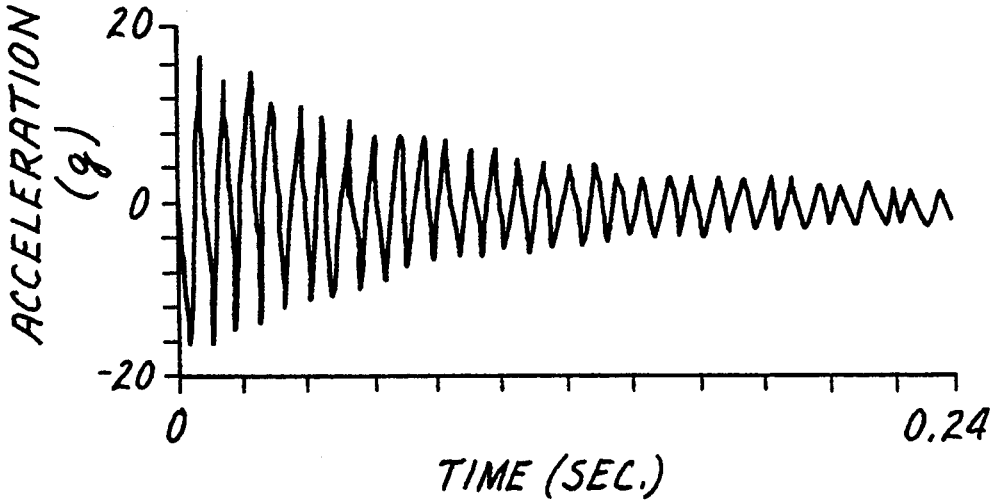
FIG. 18A is a graph of the vibration time trace of an impacted aluminum racket of a second embodiment of the present invention.
Figure 19B:
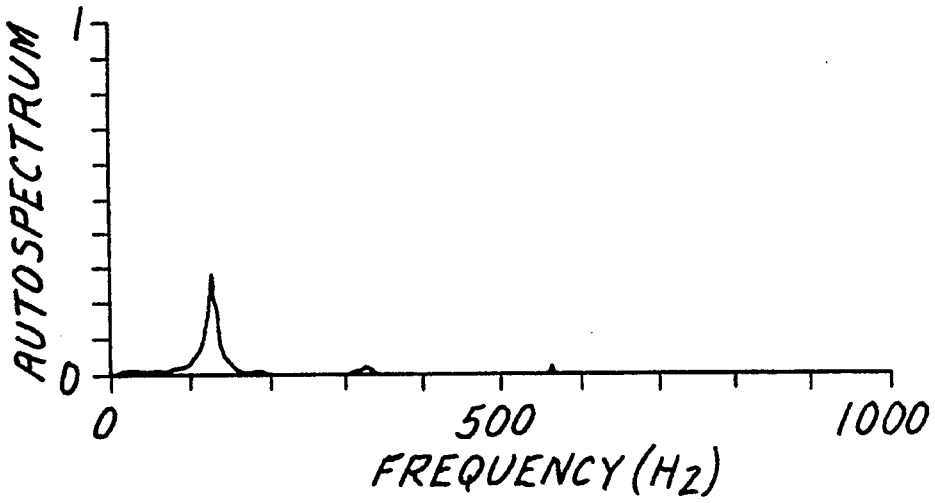
FIG. 19B is a graph of the vibration autospectrum of an aluminum impacted racket of a third embodiment of the present invention.
Figure 19A:
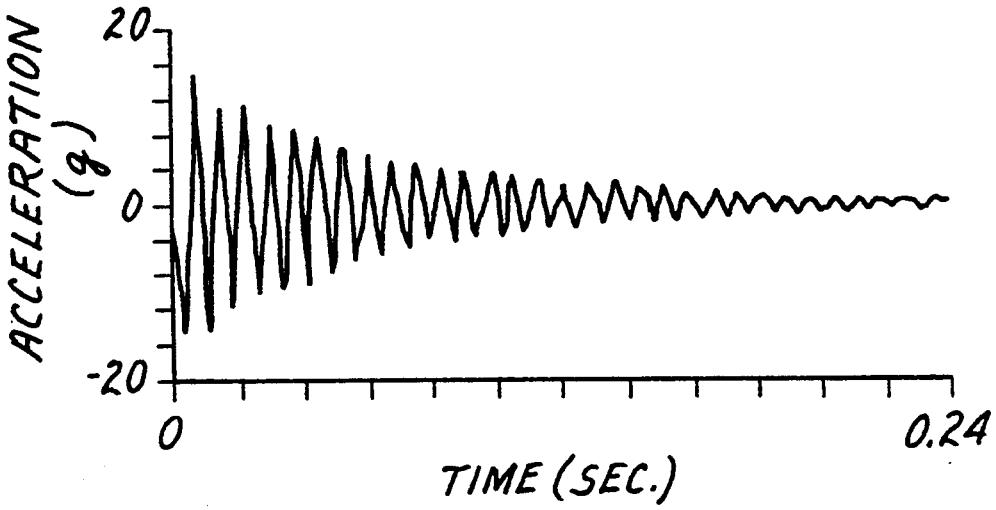
FIG. 19A is a graph of the vibration time trace of an impacted aluminum racket of a third embodiment of the present invention.
Figure 20B:
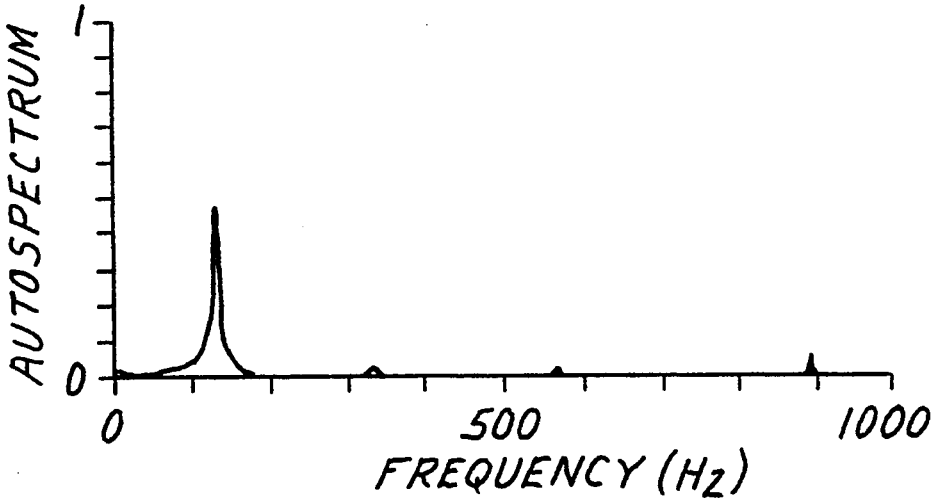
FIG. 20B is a graph of the vibration autospectrum of an aluminum impacted racket of a fourth embodiment of the present invention.
Figure 20A:
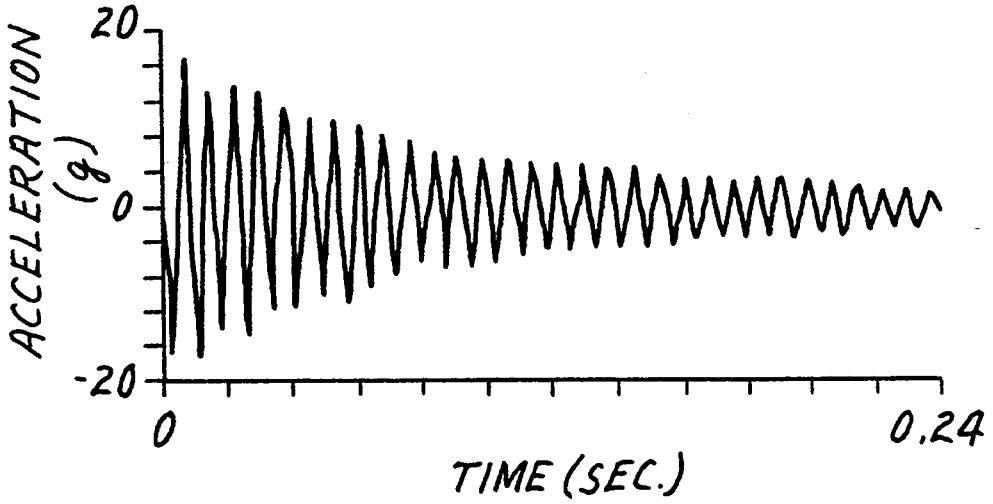
FIG. 20A is a graph of the vibration time trace of an impacted aluminum racket of a fourth embodiment of the present invention.

The test racket of Comparative Example 3 comprised a mid-size aluminum racket sold under the trade name Pro Kennex Power Prophecy 110. This racket was tested in accordance with the procedures of Example 1. The test results are reported in FIGS. 16A and 16B. The damping ratio is reported in Table 3.

TABLE 3

| Ex. | Description of Treatment | Faces | Damping Ratio (%) |
|---|---|---|---|
| 8 | Long Damping Elements | Both | 2.40 |
| C3 | No Damping Elements | None | 0.77 |
| 9 | Long Damping Elements | One | 1.40 |
| 10 | Short Damping Elements | Both | 2.10 |
| 11 | Short Damping Elements | One | 1.40 |

The rackets of Examples 8–11 showed noticeable improvements in the damping ratio when compared to the racket of Comparative Example 3. The time decay of the acceleration of the rackets of Examples 8–11 as illustrated in FIGS. 17–20, respectively, was noticeably faster than the decay exhibited by the racket of Comparative Example 3. Similarly, the first modal frequency response of an impacted racket was visibly lower than response of the racket of Comparative Example 3 indicating that more energy was dissipated in the rackets of the present invention than the racket of Comparative Example 3.

EXAMPLES 12–15

The test rackets of Examples 12–15 comprised a graphite racket sold under the tradename Wilson Profile 3.6 Si strung with Babolat string at 26 kg. The test rackets were constructed and tested in accordance with the method of Example 1. Examples 12 and 13 demonstrated the effect of long damping element placement. Examples 14 and 15 illustrated the placement of short damping elements. The test results for Examples 12–15 are reported in FIGS. 22–25, respectively. The location and the lengths of the damping elements of Examples 12–15 are summarized in Table 4.

COMPARATIVE EXAMPLE 4

Figure 21B:
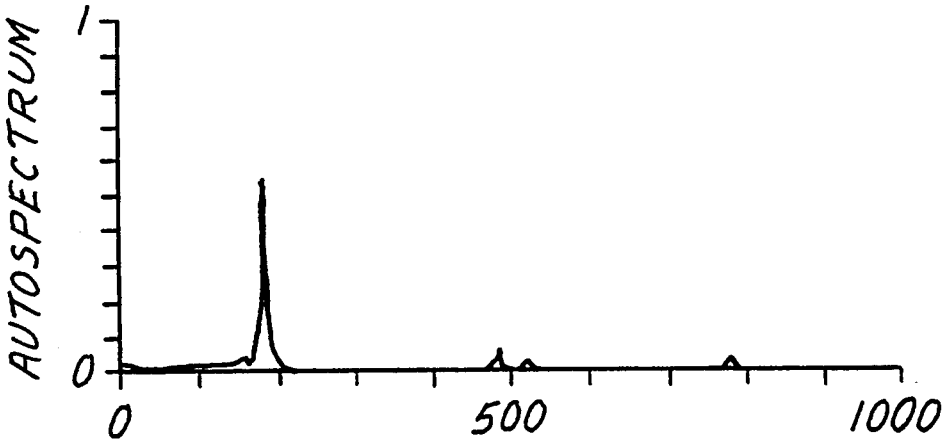
FIG. 21B is a graph of the vibration autospectrum of an impacted graphite racket.
Figure 21A:
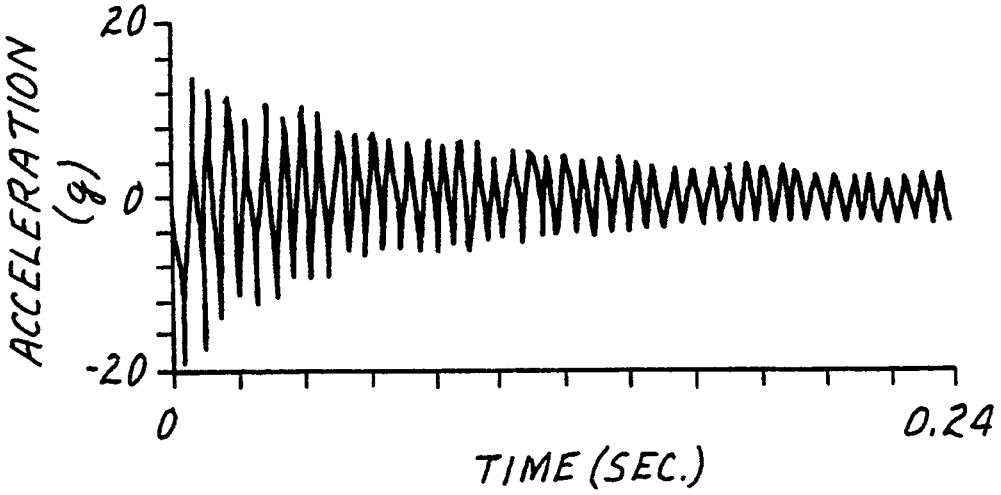
FIG. 21A is a graph of the vibration time trace of an impacted graphite racket.
Figure 22B:
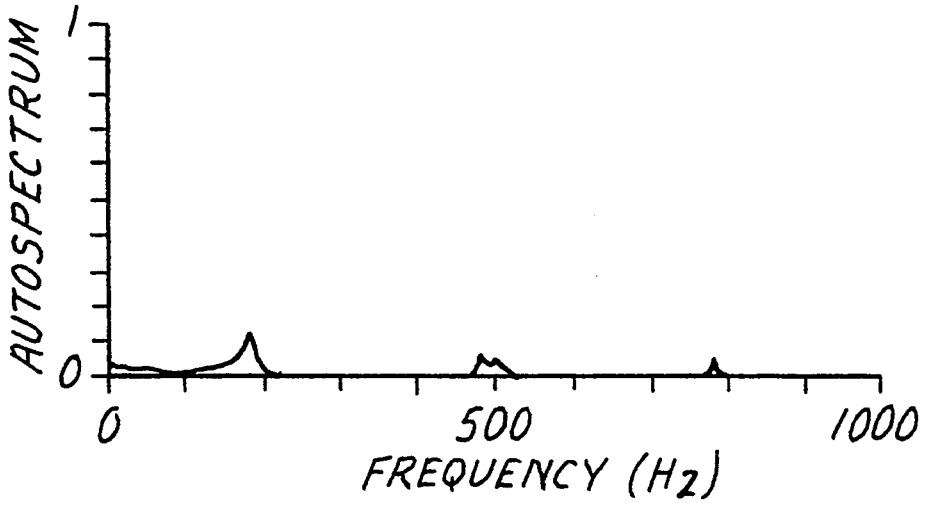
FIG. 22B is a graph of the vibration autospectrum of an graphite impacted racket of one embodiment of the present invention.
Figure 22A:
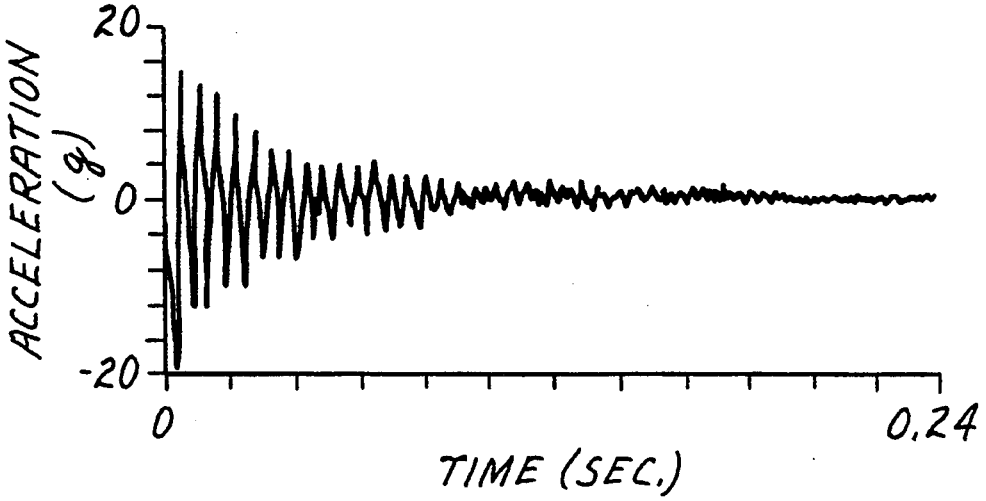
FIG. 22A is a graph of the vibration time trace of an impacted graphite racket of one embodiment of the present invention.
Figure 23B:
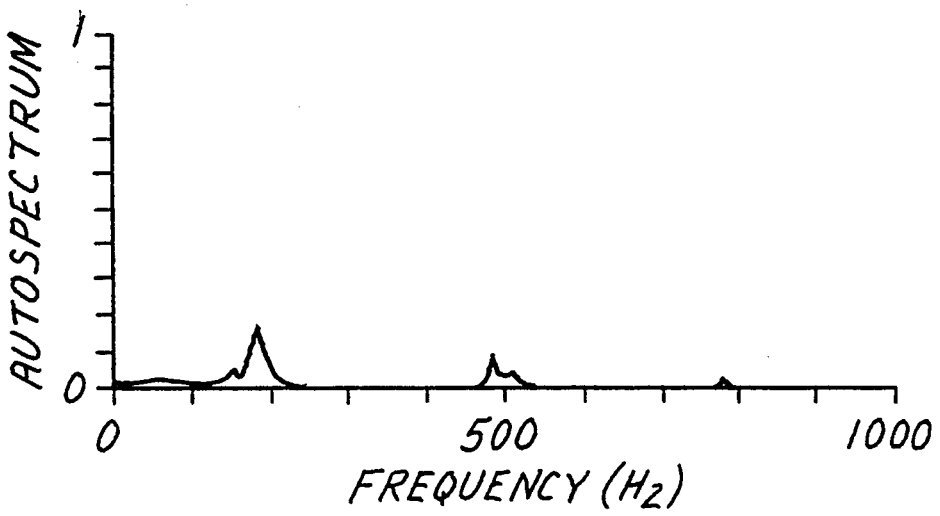
FIG. 23B is a graph of the vibration autospectrum of an impacted graphite racket of a second embodiment of the present invention.
Figure 23A:
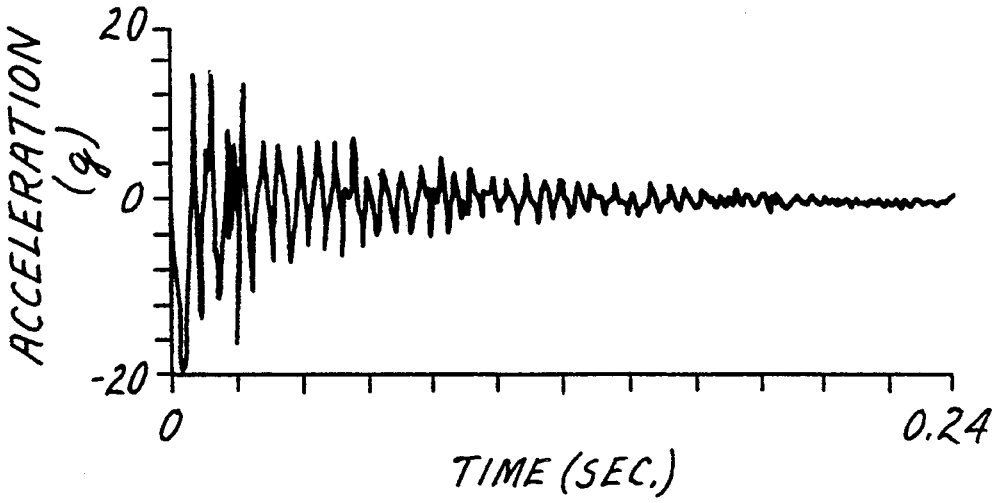
FIG. 23A is a graph of the vibration time trace of an impacted graphite racket of a second embodiment of the present invention.
Figure 24B:
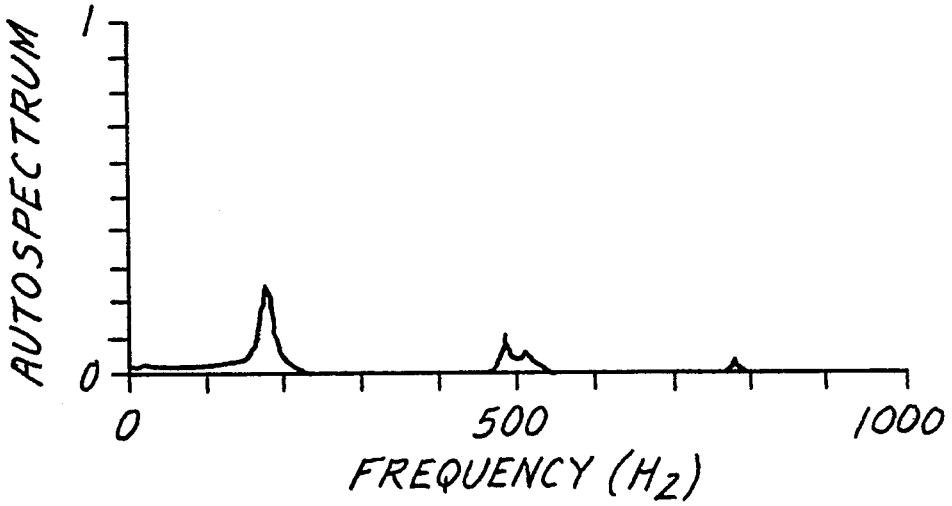
FIG. 24B is a graph of the vibration autospectrum of an graphite impacted racket of a third embodiment of the present invention.
Figure 24A:
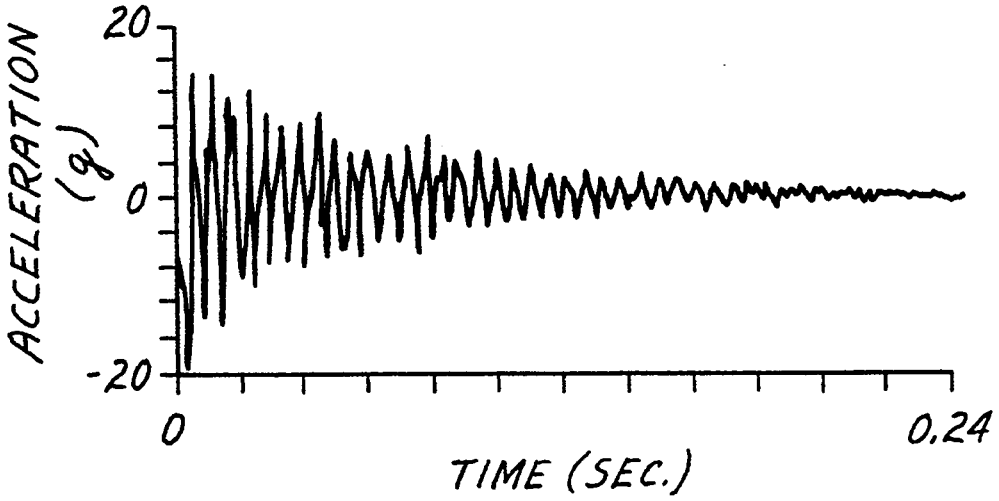
FIG. 24A is a graph of the vibration time trace of an impacted graphite racket of a third embodiment of the present invention.
Figure 25B:
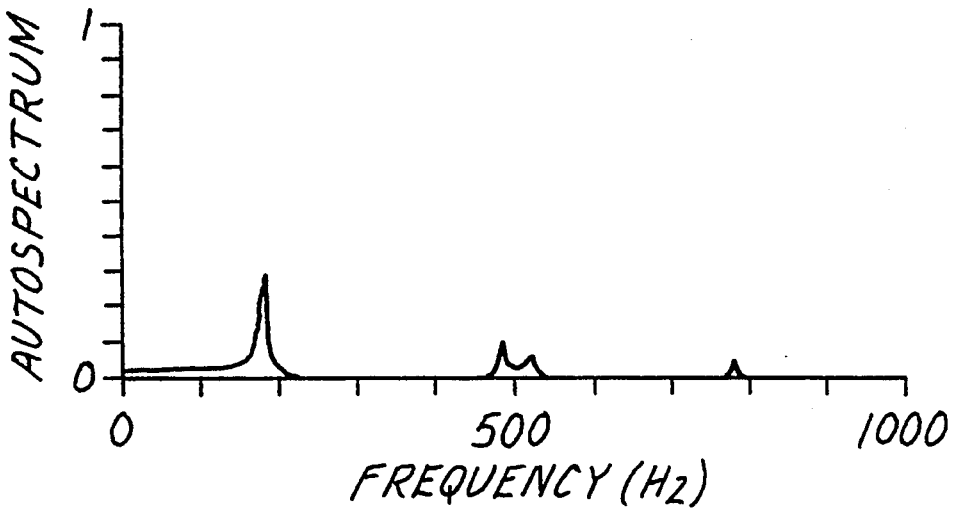
FIG. 25B is a graph of the vibration autospectrum of an graphite impacted racket of a fourth embodiment of the present invention.
Figure 25A:
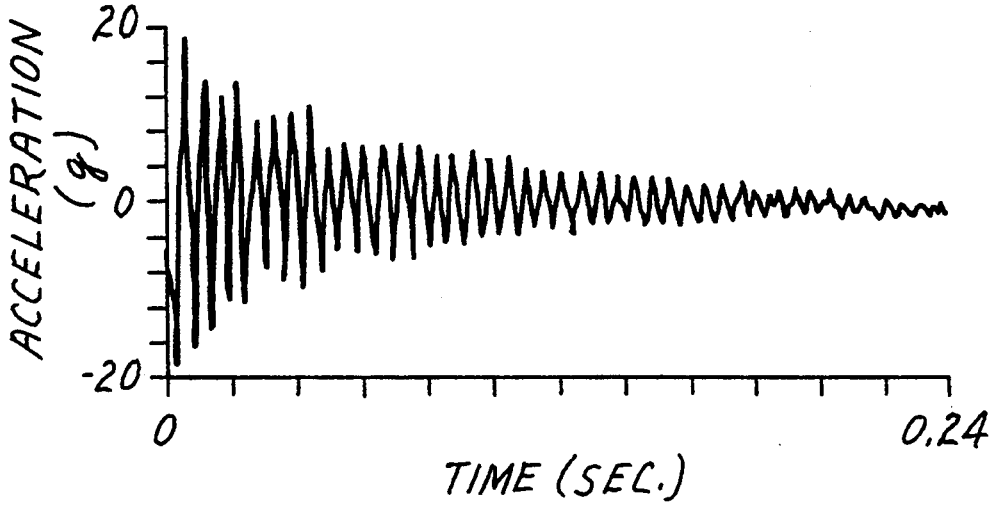
FIG. 25A is a graph of the vibration time trace of an impacted graphite racket of a fourth embodiment of the present invention.

The test racket of Comparative Example 4 comprised a graphite racket sold under the tradename Wilson Profile 3.6 Si strung with Babolat string at 26 kg. This racket was tested in accordance with the procedures of Example 1. The test results are reported in FIGS. 21A and 21B. The damping ratio is reported in Table 4.

TABLE 4

| Ex. | Description of Treatment | Faces | Damping Ratio (%) |
|---|---|---|---|
| 12 | Long Damping Elements | Both | 2.60 |
| C4 | No Damping Elements | None | 0.37 |
| 13 | Long Damping Elements | One | 1.70 |
| 14 | Short Damping Elements | Both | 1.60 |
| 15 | Short Damping Elements | One | 1.10 |

The rackets of Examples 12–15 showed noticeable improvements in the damping ratio when compared to the racket of Comparative Example 4. The time decay of the acceleration of the rackets of Examples 12–15 as illustrated in FIGS. 21–25, respectively, was noticeably faster than the decay exhibited by the racket of Comparative Example 4. Similarly, the first modal frequency response of an impacted racket was lower than the response of the racket of Comparative Example 4 indicating that more energy was dissipated in rackets of the present invention than the racket of Comparative Example 4.

In summary, a novel and unobvious racket utilizing damping elements has been described. Although specific embodiments and examples have been disclosed herein, it should be borne in mind that these have been provided by way of explanation and illustration and the present invention is not limited thereby. Certainly modifications which are within the ordinary skill in the art are considered to lie within the scope of this invention as defined by the following claims.

We claim:

1. A tennis racket, comprising a tubular frame defining a i) head having a first face and a second face, ii) bridge and iii) handle, and at least one vibration damping element secured to a surface within said tubular frame corresponding to the inner surface of said first face, said vibration damping element extending substantially only from about a point equidistant from the top of said head and the center of said head, through said bridge, to the top of said handle.

2. A tennis racket according to claim 1, comprising a second vibration damping element secured to the surface within said tubular frame corresponding to the inner surface of said second face and extending substantially only from about a point equidistant from the top of said head and the center of said head, through said bridge, to the top of said handle.

3. A tennis racket according to claim 2, wherein said second vibration damping element is substantially unconstrained.

4. A tennis racket according to claim 1, wherein said damping element comprises a viscoelastic material.

5. A tennis racket according to claim 4, wherein said viscoelastic material comprises an acrylic viscoelastic polymer.

6. A tennis racket according to claim 1, wherein said vibration damping element is substantially unconstrained.

* * * * *